US009334084B2

(12) United States Patent
Whitton et al.

(10) Patent No.: US 9,334,084 B2
(45) Date of Patent: May 10, 2016

(54) CONTAINER HAVING A USE INDICATOR

(71) Applicant: Owens-Brockway Glass Container Inc., Perrysburg, OH (US)

(72) Inventors: Michael J. Whitton, Melbourne (AU); Roger P. Smith, Perrysburg, OH (US); Jessica R. Bryant, Toledo, OH (US); Diana Darvish, Saint-Petersburg (RU); Anatoly Solunin, Saint-Petersburg (RU); Nikolay Taratin, Saint-Petersburg (RU)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 75 days.

(21) Appl. No.: 13/832,589

(22) Filed: Mar. 15, 2013

(65) Prior Publication Data

US 2014/0263158 A1 Sep. 18, 2014

(51) Int. Cl.

| | |
|---|---|
| ***A61J 1/00*** | (2006.01) |
| ***B65D 39/00*** | (2006.01) |
| ***B65D 85/00*** | (2006.01) |
| ***B65D 23/00*** | (2006.01) |
| ***B65B 3/04*** | (2006.01) |
| ***B65D 23/12*** | (2006.01) |
| ***B65D 1/02*** | (2006.01) |

(52) U.S. Cl.

CPC . *B65D 23/00* (2013.01); *B65B 3/04* (2013.01); *B65D 1/023* (2013.01); *B65D 23/12* (2013.01); *B65D 2101/0084* (2013.01)

(58) Field of Classification Search

CPC ..... B65D 49/00; B65D 55/026; B65D 1/023; B65D 2101/00; B65D 55/066; B65B 3/04; B65B 43/00; B23P 11/00

USPC ..... 215/366, 230; 206/459.1; 220/DIG. 34

See application file for complete search history.

(56) References Cited

U.S. PATENT DOCUMENTS

| | | | | | |
|---|---|---|---|---|---|
| 641,108 | A | * | 1/1900 | Hemstreet | 215/366 |
| 1,042,669 | A | | 10/1912 | Gruver | |
| 2,091,460 | A | | 8/1937 | Valliant et al. | |
| 2,144,880 | A | * | 1/1939 | Hellman | 215/366 |
| 3,399,811 | A | | 9/1968 | Miller | |
| 3,603,472 | A | | 9/1971 | Lecinski, Jr. et al. | |
| 3,899,295 | A | | 8/1975 | Halpern | |
| 4,182,461 | A | | 1/1980 | Waldau | |
| 4,411,369 | A | | 10/1983 | Borows | |
| 4,449,637 | A | | 5/1984 | Snedker | |
| 4,489,841 | A | | 12/1984 | Thompson | |
| 4,502,605 | A | | 3/1985 | Wloszczyna | |
| 4,505,399 | A | | 3/1985 | Weiner | |
| 4,511,052 | A | | 4/1985 | Klein et al. | |
| 4,816,305 | A | | 3/1989 | Stillwell et al. | |
| 5,443,987 | A | | 8/1995 | DeCicco et al. | |
| 5,617,812 | A | * | 4/1997 | Balderson et al. | 116/206 |
| 5,806,697 | A | | 9/1998 | Harbutt et al. | |
| 5,971,179 | A | | 10/1999 | Christmas et al. | |
| 6,378,906 | B1 | | 4/2002 | Pennaz | |

(Continued)

OTHER PUBLICATIONS

PCT Search Report and Written Opinion, Int. Serial No. PCT/US2014/020671, Int. Filing Date: Mar. 5, 2014, Applicant: Owens-Brockway Glass Container Inc., Mail Date: Jun. 17, 2014.

*Primary Examiner* — Shawn M Braden

(57) ABSTRACT

A product includes a container, and an indicator that is carried inside the container and that exhibits a first visible characteristic, and a second, different visible characteristic when exposed to air.

24 Claims, 8 Drawing Sheets

(56) References Cited

U.S. PATENT DOCUMENTS

2014/0076933 A1* 3/2014 Chisholm ..... 222/147
2014/0138274 A1* 5/2014 Smith et al. ..... 206/459.1
2014/0260116 A1* 9/2014 Cooper ..... 53/492
2014/0262898 A1* 9/2014 Anderson et al. ..... 206/459.1
2014/0263152 A1* 9/2014 Smith et al. ..... 215/47
2014/0263158 A1* 9/2014 Whitton et al. ..... 215/366

* cited by examiner

CONTAINER HAVING A USE INDICATOR

The present disclosure is directed to containers and, more particularly, to containers having anti-counterfeit features.

BACKGROUND AND SUMMARY OF THE DISCLOSURE

Many containers are provided with tamper-resistant devices to resist refilling of contents in the containers. For example, a container for carrying a liquid product can include a fitment that renders the container non-refillable, so as to impede efforts to refill the container with inferior products. U.S. Pat. No. 3,399,811 illustrates a container of this type.

A general object of the present disclosure, in accordance with one aspect of the disclosure, is to provide a product and/or package including a container and a use-evident indicator carried by the container for indicating that the product and/or package has been used.

The present disclosure embodies a number of aspects that can be implemented separately from or in combination with each other.

A package in accordance with one aspect of the disclosure includes a container, a product dispensably disposed within the container, a closure carried by the container, and an indicator within the container. The indicator is adapted, upon contact with air, irreversibly to change a characteristic of the indicator that is visible from outside of the container to indicate to a user that the package has been used.

In accordance with a further aspect of the disclosure, there is provided a product that includes a container, and an indicator carried inside the container, and including an air-reactive material and a protective material on the air-reactive material, and having a first visible characteristic with the protective material, and a second visible characteristic when exposed to air without the protective material.

In accordance with another aspect of the disclosure, there is provided a method of producing a product that includes (a) positioning an air-reactive indicator inside of a container, wherein the indicator includes a protective material and has an initial visible characteristic, (b) flowing product into the container, and (c) assembling a closure to the container.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
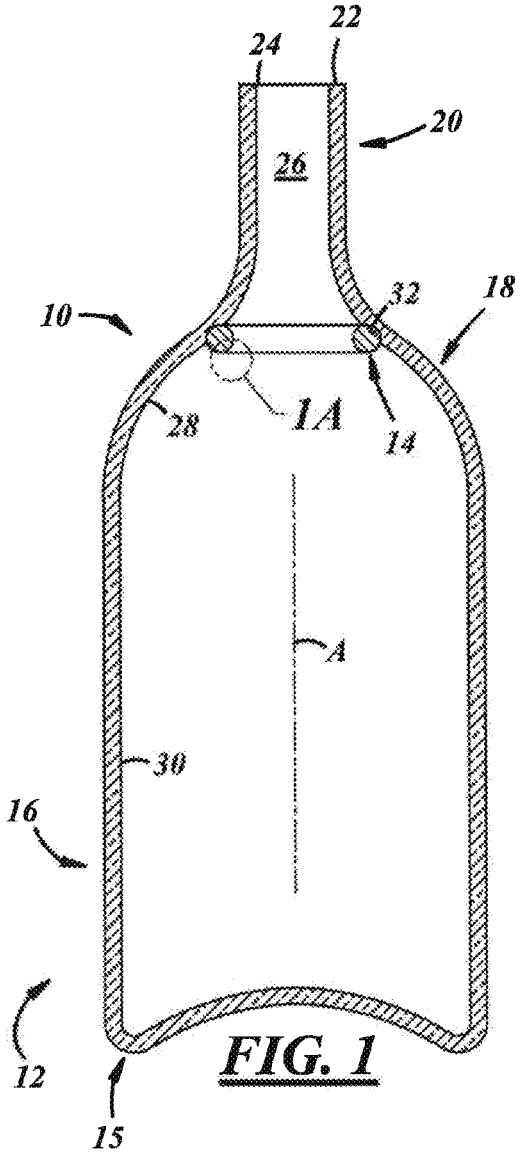
FIG. 1 is an elevational cross-sectional view of a product in accordance with an illustrative embodiment of the present disclosure and including a container and a use indicator coupled to the container and shown in an initial or deactivated state.

FIG. 1 illustrates a product 10 in accordance with an illustrative embodiment of the disclosure as including a container 12 for containing an original product and a use indicator 14 carried inside the container 12. As used herein, the term "use" may include design intent use, for example, package opening, product dispensing, and/or the like, but also may include unintended or unauthorized use by a counterfeiter, for example, product withdrawal, for instance, via suction, or the like. The indicator 14 may be non-removably secured to the container 12, or coupled to the container 12 in any other suitable manner. The terminology "non-removably secured" includes a manner in which the indicator 14 is, by design-intent, not intended to be removed from the container 12 without damaging the container 12 and/or indicator 14 or otherwise visibly compromising the structural and/or functional integrity of either or both. As will be described below, the indicator 14 may evidence dispensing of original product from the container 12 for example, via a state change of the indicator 14 after original product has been dispensed from the container 12. Accordingly, the state changed indicator 14 will deter a counterfeiter from refilling and/or repackaging the container 12 with counterfeit product.

Still referring to FIG. 1, the container 12 may be of one-piece integrally formed construction, preferably glass or plastic construction. (The term "integrally formed construction" does not exclude one-piece integrally molded layered glass constructions of the type disclosed for example in U.S. Pat. No. 4,740,401, or one-piece glass bottles to which other structure is added after the bottle-forming operation.) The container 12 may be fabricated in press-and-blow or blow-and-blow glass container manufacturing operations, or in plastic injection and/or blow molding operations, or in any other suitable manner.

The container 12 may include a base 15 on which the container 12 may be supported, a body 16 extending axially from the base 15, a shoulder 18 extending radially and axially from the body 16, and a neck 20 extending axially from the shoulder 18. As used herein, the term axial includes oriented generally along a longitudinal axis of the closure, container, or package and may include but is not limited to a direction that is strictly parallel to a container longitudinal central axis A. The neck 20 may include a lip or axial outward end surface 22, a mouth 24, and an interior surface 26. Similarly, the shoulder 18 may include an interior surface 28, and the body 16 may include an interior surface 30.

The container 12 may be of any suitable shape. For example, the body 16 and the neck 20 may be generally cylindrical, as illustrated, or they may be tapered or of any other suitable shape. In the illustrated embodiment, the shoulder 18 may be excurvate or outwardly bulging with respect to the axis A, extending from the body 16. The shoulder 18 may be incurvate or inwardly bulging with respect to the axis A, extending from the neck 20.

The indicator 14 may be carried in any suitable location of the container 12. Preferably, however, the indicator 14 is carried in a location that is difficult to reach from outside of the container 12 to resist efforts by a counterfeiter to tamper with the indicator 14. In the illustrated embodiment, for example, the indicator 14 may be carried in the interior of the container 12 by the shoulder 18. More particularly, the indicator 14 may be carried in a relief in an interior surface of the container 12, for example, in the interior surface of the shoulder 18. In the illustrated embodiment, the relief includes an annular groove 32, which may be formed during manufacture of the container 12, in any suitable manner. The groove 32 may extend circumferentially around the container 12 and may be continuous or uninterrupted. As illustrated, the groove 32 may be disposed radially outboard of an inner diameter of the neck 20. More specifically, the groove 32 may have an inner diameter greater than that of the inner diameter of the neck 20. Likewise, the indicator 14 may have an outer diameter greater than that of the inner diameter of the neck 20. Also, as illustrated, the indicator 14 may have an inner diameter that is greater than that of the inner diameter of the neck 20. In other embodiments, the indicator 14 may be carried by other portions of the container 12. For example, the indicator 14 may be carried by an upper portion of the body 16, in a groove or otherwise. Also, the indicator 14 may be coupled to the container 12 by an adhesive.

The indicator 14 may be of any suitable shape to facilitate assembly to the container 12. For example, the indicator 14 may be a semi-circular or fully circular ring of circular transverse cross-section. The indicator 14 may be carried inside the container 12 in any suitable manner. For example, the indicator 14 may be snap fit or otherwise interference fit within the corresponding groove 32 in an inside surface of the container 12. In another example, the indicator 14 may be axially trapped between a pair of spaced apart internal embossments (not shown) projecting radially inwardly from an inside surface of the container 12. In one embodiment, the indicator 14 may be a component separate from the container 12, and may be flexible to facilitate assembly into the container 12. In another embodiment, the indicator 14 may include a coating applied, in situ, to the container 12.

Figure 3:
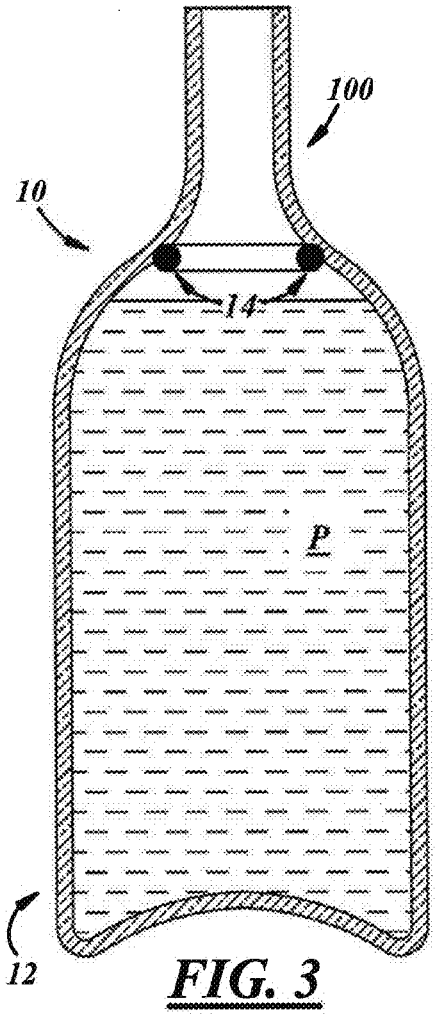
FIG. 3 is an elevational cross-sectional view of the package of FIG. 2, illustrating the closure and cover removed from the container, a portion of the liquid content removed, and the use indicator shown in an activated state.
Figure 4:
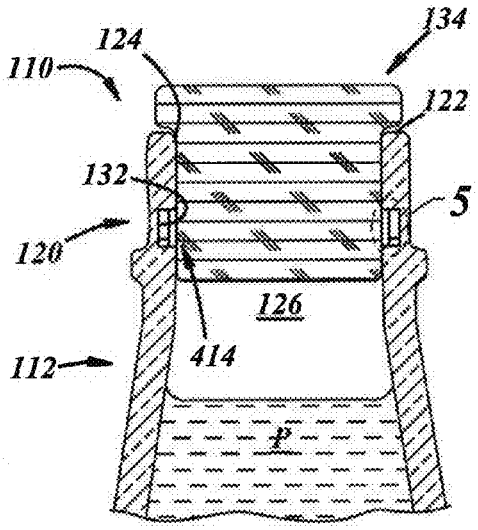
FIG. 4 is an elevational, fragmentary, cross-sectional view of a package in accordance with another illustrative embodiment of the present disclosure and including a container, a closure coupled to the container, and a use indicator coupled to the container and positioned between the closure and the container.

The indicator 14 may be the same as or similar to an indicator ring disclosed and shown in conjunction with FIGS. 3 and 4 of U.S. patent application Ser. No. 13/832,659 filed Mar. 15, 2013 entitled CONTAINER NECK RING), which was filed on the same date as the present application and is assigned to the assignee hereof and is incorporated herein by reference in its entirety.

Figure 1A:
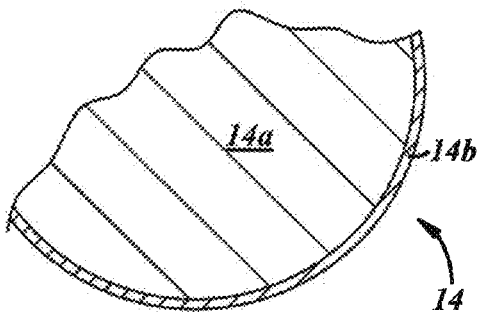
FIG. 1A is an enlarged fragmentary sectional view of the use indicator of FIG. 1, taken from circle 1A of FIG. 1.

With reference to FIG. 1A, the indicator 14 may be of any suitable composition(s) and constructed in any suitable manner to enable the indicator 14 to exhibit different visual characteristics. For example, the indicator 14 may be composed of an air-reactive material 14*a*, and a protective element or material 14*b* carried by the air-reactive material 14*a*. In the embodiment illustrated in FIG. 1A, the protective material 14*b* is carried directly on the air-reactive material 14*a*.

The air-reactive material 14*a* may be, or may include, a material that reacts with any one or more of the constituents of air so as to visibly change appearance of the material. For example, the air-reactive material 14*a* may include, more particularly, an oxygen-reactive material or a nitrogen-reactive material. More specifically, the air-reactive material 14*a* may include oxygen-reactive metals, polymers, or dyes. For instance, the air-reactive material 14*a* may include copper, iron, potassium, sodium, PEN (polyethylene naphthalate), or polycarbonate.

The protective material 14*b* may include a protective coating, protective component, or any other suitable protective material that may be composed of a protective material that may be impermeable to any one or more of the constituents of air, and/or may selectively absorb any one or more constituents of air, so as to protect the air-reactive material 14*a*, but that is readily dissolvable by the product in the container 12 so as to prepare the air-reactive material 14*a* for exposure to air when the package 10 is opened and product is dispensed therefrom. An example of the impermeable protective material may include polyacrylic acid, polyacrylamide, xanthan gum, pectin, chitosan derivatives, dextran, carrageenan, guar gum, and/or cellulose ethers, for instance, hydroxypropylmethyl cellulose (HPMC), hydroxypropyl cellulose (HPC), hydroxyethyl cellulose (HEC), and/or sodium carboxy methyl cellulose (Na-CMC). An example of the selectively absorbing material may be a scavenging material that prevents air constituents from reaching the air-reactive material 14*a*, and may include any of the materials discussed below with respect to scavenging material 414*c*.

The indicator 14 may be produced in any suitable manner. For example, in one embodiment, the air-reactive material 14*a* itself may be injection or compression molded, metal formed, glass or ceramic press formed, or produced in any other suitable manner. In another embodiment, the protective material 14*b* may be sprayed on a substrate, applied to a substrate by dipping, or may be applied in any other suitable manner to a substrate.

Upon initial manufacture, and after being produced with the material 14*b*, the air-reactive material 14*a* may exhibit a first visual characteristic, for example, a first color or other appearance. But when exposed to air, for example, after removal of the material 14*b*, the air-reactive material 14*a* may exhibit a second visual characteristic, for example, a second color or other appearance. As used herein, the term "removal" may include complete or partial removal. For example, the material 14*b* may be displaced so as to allow the air-reactive material 14*a* to be exposed to air but need not be completely removed therefrom.

The indicator 14 is assembled to the container 12 with the protective material 14*b* carried on the air-reactive material 14*a*. The indicator 14 exhibits the first visual characteristic, for example, the first color. In one embodiment, the material 14*b* may be transparent or at least translucent, such that the color of the air-reactive material 14*a* is visible.

In the illustrated embodiment, the use indicator 14 provides an indication that product has been poured out of the container 12, withdrawn from the container 12 via suction or the like, or otherwise dispensed from the container 12 in any other manner. But it is also contemplated that the use indicator 14 could provide an indication of closure removal and subsequent exposure to air.

Figure 1B:
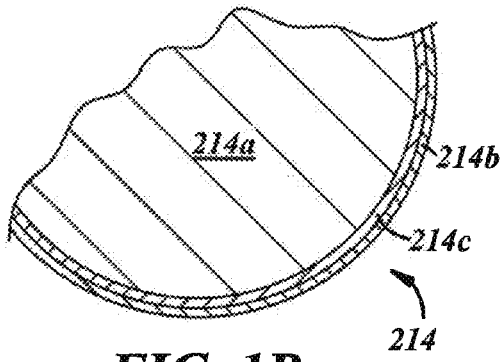
FIG. 1B is an enlarged fragmentary sectional view of another illustrative embodiment of a use indicator.

Referring now to FIG. 1B, in another embodiment, an indicator 214 may include a carrier material 214*a* that is not itself composed of an air-reactive material, an air-reactive material 214*c* carried directly on the carrier material 214*a*, and a protective material 214*b* carried by the carrier material 214*a* but applied over the reactive material 214*c*, such that the reactive material 214*c* is disposed between the carrier material 214*a* and the protective material 214*b*. The carrier material 214*a* may include, for example, a glass, ceramic, metal, or polymer, and the reactive material 214*c* may include one or more flavonoids, for example, flavanones, flavanoles and dihydrochalcones, chalcones, aurones, or anthocyanidins, depending on the reaction and desired color. Also, the reactive material 214*c* may include any of the materials previously described above with respect to the air-reactive material 14*a* (FIG. 1A). Likewise, the protective material 214*b* may include any of the materials previously described above with respect to the material 14*b* (FIG. 1B).

Figure 1C:
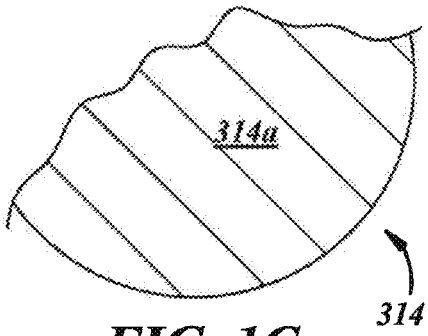
FIG. 1C is an enlarged fragmentary sectional view of a further illustrative embodiment of a use indicator.

Referring now to FIG. 1C, in another embodiment, an indicator 314 may include an air-reactive material 314*a* and need not include any coatings or layers applied thereto. For example, the indicator 314 may include a material that is relatively unreactive with any one or more of the constituents of air when the material is dry, but, when the material is wet, is relatively reactive with any one or more of the constituents of air so as to visibly change appearance of the material. More specifically, the air-reactive material 314*a* may include iron or any other material that, when wet, reacts with air to cause a change in color or other appearance.

Figure 2:
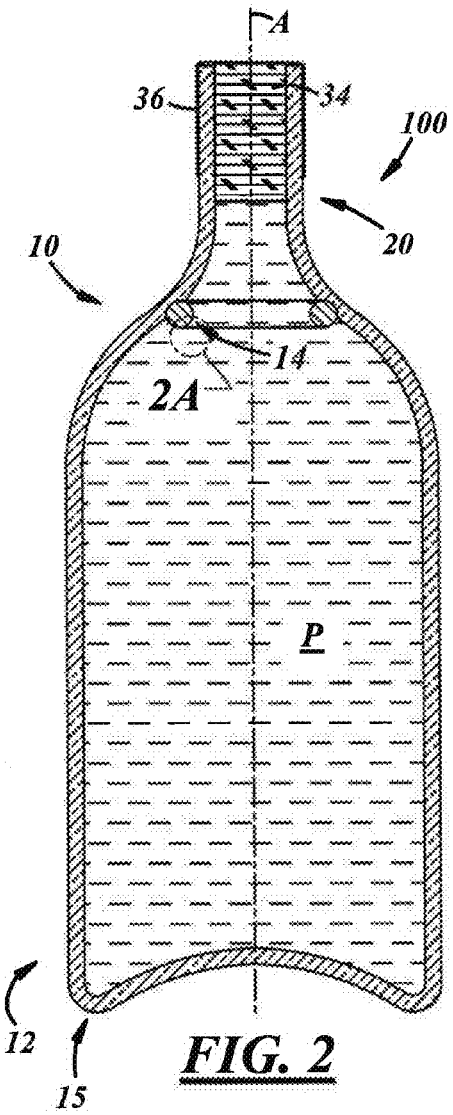
FIG. 2 is an elevational cross-sectional view of a package including the product of FIG. 1, liquid content in the container and covering the use indicator, and a closure and a cover coupled to the container.
Figure 2A:
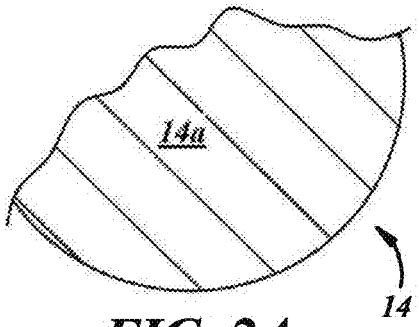
FIG. 2A is an enlarged fragmentary sectional view of the use indicator, taken from circle 2A of FIG. 2.

Referring now to FIGS. 2 and 2A, an original flowable product P may be dispensably disposed within the container 12 of the product 10, and a closure 34 may be coupled to the container 12 to establish a package that is factory sealed or in its original factory sealed state or condition. For example, a beverage manufacturer may fill the container 12 with an authentic or original beverage at a packaging plant or factory and close the container 12 with a closure 34 and, optionally, a cover 36, which may be coupled to the neck 20 of the container 12. Thereafter, the closure 34 and cover 36 may be removed and the flowable product P dispensed out of the container 12 through the neck 20. The closure 34 may include a cork, plug, crown, twist-off, or any other suitable closure. The cover 36 may include a metal foil, plastic cup, wax seal, or any other suitable cover. The flowable product P may include any liquid or flowable solid, for instance, a food, or a beverage, for instance, beer, wine, liquor, soda, other beverage, or any other suitable liquid or flowable food product. Accordingly, the package 10 leaves the packaging plant in an original factory sealed condition.

The indicator 14 may be carried by a portion of the container 12 that is closer to the neck 20 than to the bottom 15 so that, for instance, the indicator 14 is located relatively close to an upper surface of the flowable product P when the container 12 is filled with the flowable product P. In fact, the indicator 14 may be carried only in such an upper portion of the container 12. Accordingly, the indicator 14 is exposed to the flowable product P in the container 12 and, the protective material (not shown) has been dissolved off of the air-reactive material 14*a* by the flowable product P (or the indicator 14 did not include any protective material to begin with). The indicator 14 may exhibit the first visual characteristic and is shown in its initial state of use when the indicator 14 is normally covered by the flowable product P within the container 12.

But, referring now to FIG. 3, upon contact with air when the flowable product P is dispensed from the container 12 and/or when the level of the flowable product P in the container 12 falls below the height of the indicator 14 such that the product 12 no longer covers the indicator 14, the indicator 14 is adapted irreversibly to change a characteristic of the indicator 14 that is visible from outside of the container 12 to indicate to a user that the authentic flowable product P has been dispensed from the container 12. Accordingly, the indicator 14 will exhibit the second visual characteristic different from the first visual characteristic. For example, the indicator 14 is illustrated in FIG. 3 in a state different from that shown in FIG. 1. In particular, the indicator 14 may be a different color after the package 100 has been relieved of some of its liquid contents and the indicator 14 exposed to air.

Therefore, the indicator 14 may provide a security feature. The product 100 may be substantially or completely emptied of its original flowable product P. Thereafter, if counterfeiters attempt to refill the emptied container 12 with counterfeit product and repackage the product 10 with the closure 34 and/or cover 36, the refilled and repackaged product 10 will include the state changed indicator 14 as evidence of product refilling and repackaging.

FIGS. 4-9 illustrate another embodiment of a package 110. This embodiment is similar in many respects to the embodiment of FIGS. 1-3 and like numerals between the embodiments generally designate like or corresponding elements throughout the several views of the drawing figures. Accordingly, the descriptions of the embodiments are incorporated into one another, and description of subject matter common to the embodiments generally may not be repeated here.

In FIG. 4 the package 110 includes a product including a container 112 and a use indicator 414 carried inside the container 112, and the package 110 also includes an authentic, genuine, or original material or flowable product P filling the container 112, and a closure 134 coupled to the container 112. In the illustrated example, the package 110 is in its original factory sealed state or condition. The container 112 may include a neck 120, which may include a lip 122, a mouth 124, and an interior surface 126. The closure 134 may include a stopper type of closure, as shown, or any other suitable type of closure having a portion extending into the container neck 120. The indicator 414 may be carried in any suitable location in the container 112 and, for example, may be non-removably secured therein. More particularly, the indicator 414 may be carried in a relief of the container 112, for instance, in an interior surface of the container 112, for example, in the interior surface 126 of the neck 120. As in the illustrated embodiment, the relief may include an annular groove 132, which may extend circumferentially around the container 112 and may be continuous or uninterrupted, or interrupted. As illustrated, the indicator 414 may have an inner diameter 415 (FIG. 5) that is approximately the same size as that of portions of the neck 120 axially adjacent to the indicator 414.

Figure 5:
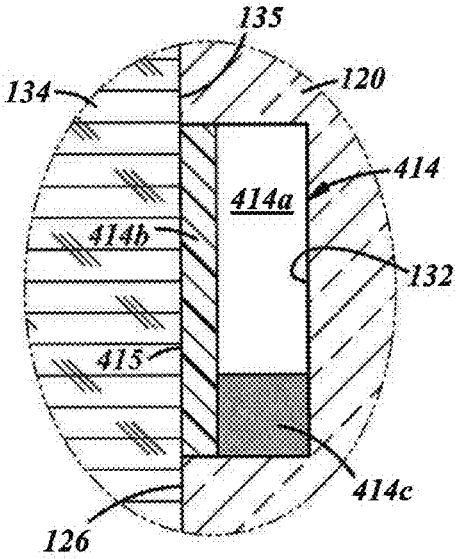
FIG. 5 is an enlarged fragmentary view of the package of FIG. 4, taken from ellipse 5 of FIG. 4.

With reference to FIG. 5, the indicator 414 may be of any suitable composition(s) and constructed in any suitable manner to enable the indicator 414 to exhibit different visual characteristics. For example, the indicator 414 may be composed of an air-reactive material 414*a* reactive to one or more constituents of air, and a protective material 414*b* carried by the air-reactive material 414*a* and establishing the inner diameter 415 of the indicator 414. As shown in FIG. 5, the indicator 414 exhibits a first visual characteristic. More specifically, the air-reactive material 414*a* may exhibit a first color, which may be white, gray, or otherwise light in appearance in one embodiment. In other embodiments, the air-reactive material 414*a* may be clear, transparent, or translucent, or may exhibit any other suitable color or any other suitable first visual characteristic.

In another example, the indicator 414 also may include a scavenging material 414*c* adjacent to the air-reactive material 414*a* to reduce or prevent premature activation of the air-reactive material 414*a* during handling and installation of the indicator 414. As illustrated, the scavenging material 414*c* may be positioned at an axially lower end of the indicator 414, or may be positioned in any other suitable manner. The scavenging material 414*c* may be composed of an oxygen scavenging material, which may include but is not limited to, iron carbonate, activated carbon, cobalt salt, iron powder, ascorbic acid, photosensitive polymers, enzymes, and/or the like. Example commercial products and sources may include FRESHMAX or FRESHPAX available from Multisorb Technologies (US), AMOSORB available from Amoco Chemicals (US), SHELFPLUS O2 available from Ciba Specialty Chemicals (CH), PURESEAL or DAREX available from W.R. Grace and Co. (US), ZERO2 available from CSIRO/Southcorp Packaging (AU), OS1000 available from Cryovac Sealed Air Co. (US), OXBAR available from CMB Technologies (UK), or a Ethylene Methyl Acrylate Cyclohexene Methyl Acrylate (EMCM) blend available from Chevron Phillips Chemical Co. (US).

As illustrated in FIGS. 4 and 5, at least a portion of the closure 134 may be friction-fit within the container neck 120 and within the indicator 414, such that removal of the closure 134 frictionally pulls the protective material 414*b*. For example, an outer diameter 135 of the closure 134 may be larger than a corresponding inner diameter 415 of the indicator 414. In one example, the closure 134 may be lubricated with any suitable lubricant, to prevent the closure 134 from prematurely damaging or displacing the indicator 414. In another example, the closure 134 can be compressed radially inwardly during insertion of the closure 134 within the container neck 120 and allowed to expand once the closure 134 is in a desired installed position within the container neck 120.

Figure 6:
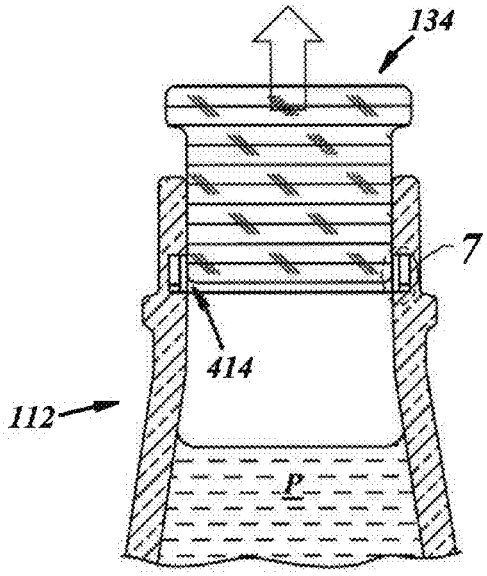
FIG. 6 is an elevational, fragmentary, cross-sectional view of the package of FIG. 4, illustrating the closure being removed from the container.
Figure 7:
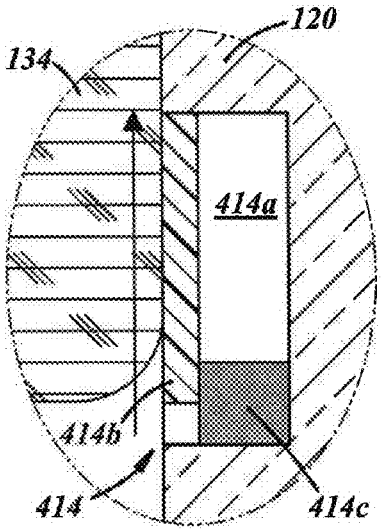
FIG. 7 is an enlarged fragmentary view of the package of FIG. 6, taken from ellipse 7 of FIG. 6.

As illustrated in FIGS. 6 and 7, the closure 134 may be removed from the container 112 for the first time after being factory sealed. More particularly, with reference to FIG. 7, removal of the closure 134 from the container neck 120 results in frictionally pulling of the protective material 414*b* away from the rest of the indicator 414 to expose the air-reactive material 414*a* to air.

Figure 8:
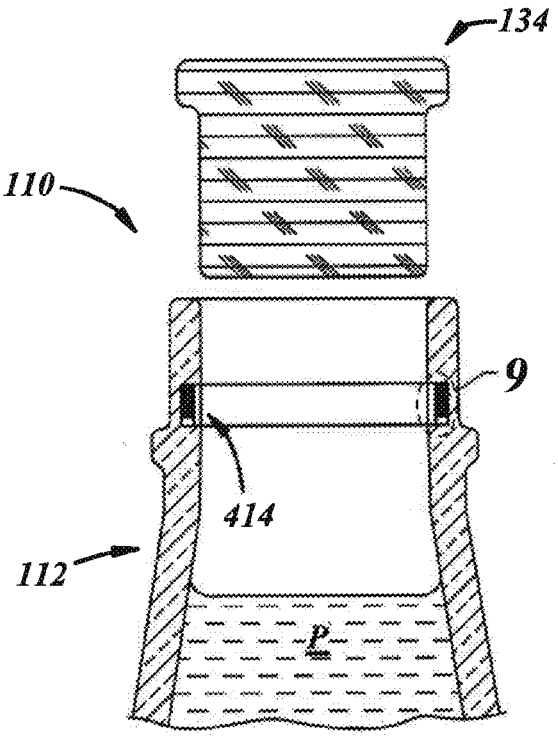
FIG. 8 is an elevational, fragmentary, cross-sectional view of the package of FIG. 4, illustrating the closure removed from the container.
Figure 9:
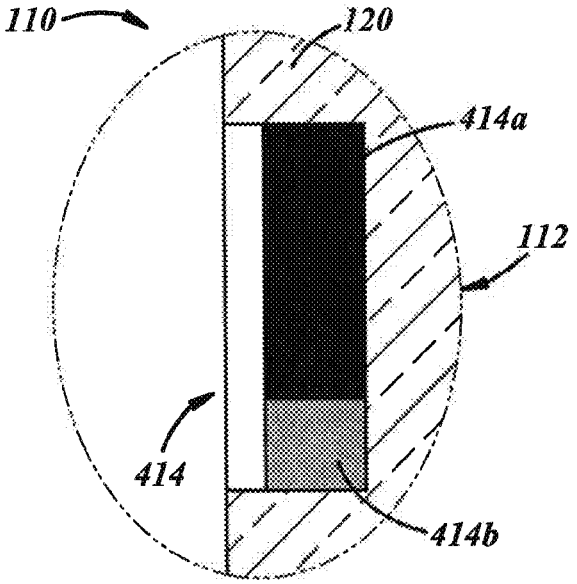
FIG. 9 is an enlarged fragmentary view of the package of FIG. 8, taken from ellipse 9 of FIG. 8, and illustrating the indicator shown in an activated state.

As illustrated in FIGS. 8 and 9, with the closure 134 and the protective material 414*b* removed, a characteristic of the indicator 414 has irreversibly changed and is visible from outside of the container 112 to indicate to a user that the integrity of an as-packaged state of the package 110 has been compromised, for example, by removal of the closure 134 from the container 112, puncturing of the closure 134 and/or container 112, breaking or damaging the seal between the closure 134 and container 112, or in any other manner. Accordingly, the indicator 414 exhibits a second visual characteristic different from the first visual characteristic. For example, the indicator 414 is illustrated in FIG. 9 in a state different from that shown in FIG. 5. In particular, the air-reactive material 414*a* of the indicator 414 may exhibit a second, different color, which may be black, or otherwise dark in appearance, in one embodiment. In other embodiments, the air-reactive material 414*a* may be partially or completely opaque, or may exhibit any other suitable color or any other suitable second visual characteristic. Accordingly, the state-changed indicator 414 may indicate design-intent use of the package 110, like first time or initial container opening after the package 110 is factory sealed.

Figure 10A:
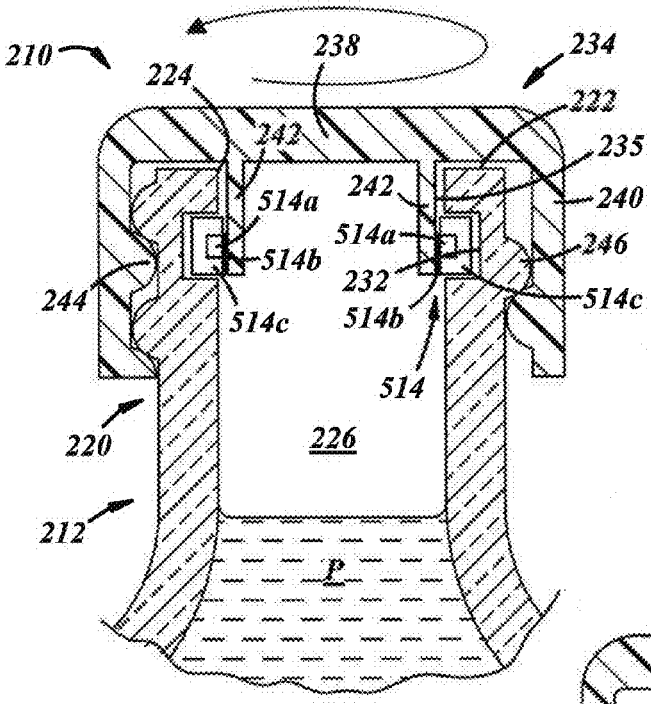
FIG. 10A is an elevational, fragmentary, cross-sectional view of a package in accordance with an additional illustrative embodiment of the present disclosure and including a container, a closure coupled to the container, and a use indicator coupled to the container and positioned between the closure and the container.
Figure 11:
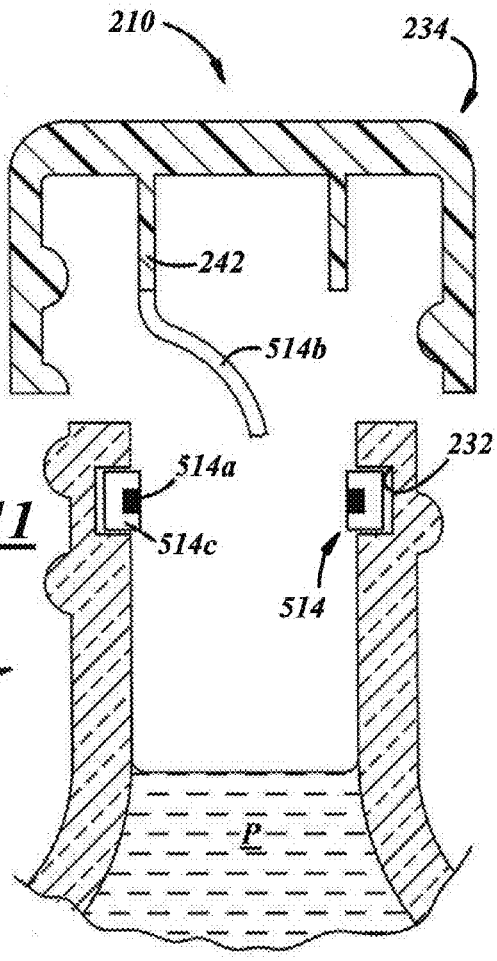
FIG. 11 is an elevational, fragmentary, cross-sectional view of the package of FIG. 10A, illustrating the closure removed from the container and a protective portion of the indicator peeled away by the closure.

FIGS. 10A-11 illustrate another embodiment of a package 210. This embodiment is similar in many respects to the embodiment of FIGS. 1-9 and like numerals between the embodiments generally designate like or corresponding elements throughout the several views of the drawing figures. Accordingly, the descriptions of the embodiments are incorporated into one another, and description of subject matter common to the embodiments generally may not be repeated here.

FIG. 10A illustrates the package 210 as including a product that includes a container 212 and a use indicator 514 carried inside the container 212, and also including a flowable product P in the container 212 and a closure 234 coupled to the container 212. The container 212 may include a neck 220, which may include a lip 222, a mouth 224, and an interior surface 226. The closure 234 may include a base wall 238, an annular outer skirt 240 extending axially from the base wall 238, and an annular inner skirt 242 extending axially from the base wall 238 radially inwardly of the outer skirt 240. The outer skirt 240 may include one or more container engagement features 244 for engagement with corresponding one or more closure engagement features 246 of the container neck 220. The engagement features 244, 246 may include thread segments, bayonet features, or any other suitable engagement features. As used herein, the term thread segment includes whole, partial, multiple, and/or an interrupted thread and/or thread segment.

The indicator 514 may be carried in any suitable location in the container 212 and, for example, may be non-removably secured therein. More particularly, the indicator 514 may be carried in a relief of the container 212, for instance, in an annular groove 232. As illustrated, the indicator 514 may have an inner diameter that is smaller than that of portions of the neck 220 axially adjacent to the indicator 514, but the inner diameter of the indicator 514 could be the same as or larger than that of the neck 220 axially adjacent to the indicator 514.

The indicator 514 may be of any suitable composition(s) and constructed in any suitable manner to enable the indicator 514 to exhibit different visual characteristics. For example, the indicator 514 may be composed of an air-reactive material 514*a* reactive to one or more constituents of air, a carrier 514*c* to carry the air-reactive material 514*a*, and a protective material 514*b* (FIG. 11) carried by and coupled to the inner skirt 242 of the closure 234. The carrier 514*c* may be composed of any suitable plastic, preferably a transparent plastic. The protective material 514*b* may be coupled to the closure skirt 242 via integral molding, adhesive, or the like. In one example, the protective material 514*b* may be laid over the air-reactive material 514*a* with or without any suitable pressure sensitive adhesive.

As shown in FIG. 10A, the indicator 514 exhibits a first visual characteristic. In one embodiment, the carrier 514*c* may be composed of a scavenging material to reduce or prevent premature activation of the air-reactive material 514*a* during handling and installation of the indicator 514.

As illustrated in FIG. 11, the closure 234 may be removed from the container neck 220, for example, in a twist off manner, such that removal of the closure 234 peels the protective material 514*b* away from the air-reactive material 514*a* to expose the air-reactive material 514*a* to air. Accordingly, with the closure 234 and the protective material 514*b* removed, a characteristic of the indicator 514 has irreversibly changed and is visible from outside of the container 212 to indicate to a user that the integrity of an as-packaged state of the package has been compromised. Accordingly, the indicator 514 exhibits a second visual characteristic different from the first visual characteristic, for example, the air-reactive material 514*a* of the indicator 514 may darken as shown in FIG. 11 from its lighter state as shown in FIG. 10A.

Figure 10B:
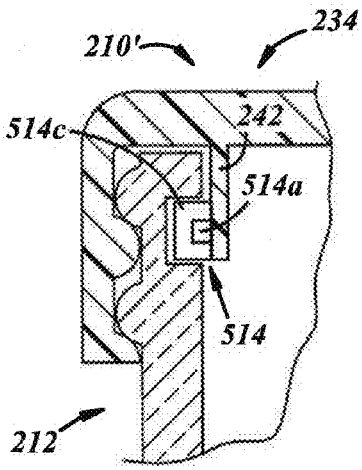
FIG. 10B is an elevational, fragmentary, cross-sectional view of a package in accordance with an yet another illustrative embodiment of the present disclosure and including the container, the closure, and the use indicator of FIG. 10A, wherein a portion of the closure establishes a protective material for the use indicator.

In a related embodiment of a package 210', FIG. 10B illustrates that the skirt 242 of the closure 234 may serve as the protective material for the indicator 514. Accordingly, an outer surface of the skirt 242 may be in contact with the air-reactive material 514*a* and the carrier 514*c*, such that removal of the closure 234 from the container displaces the skirt 242, thereby exposing the air-reactive material 514*a* to air. Therefore, the material 514*a* would exhibit a second visual characteristic different from the first visual characteristic.

Figure 12:
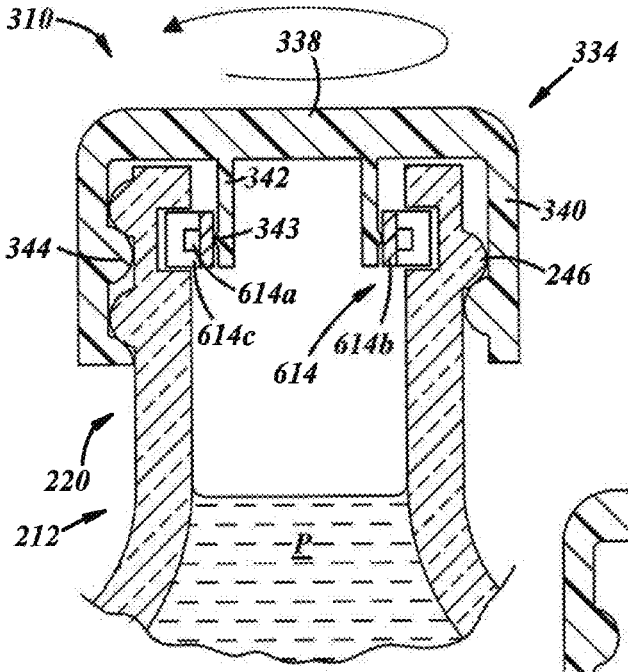
FIG. 12 is an elevational, fragmentary, cross-sectional view of a package in accordance with a further illustrative embodiment of the present disclosure and including a container, a closure coupled to the container, and a use indicator coupled to the container and positioned between the closure and the container.
Figure 13:
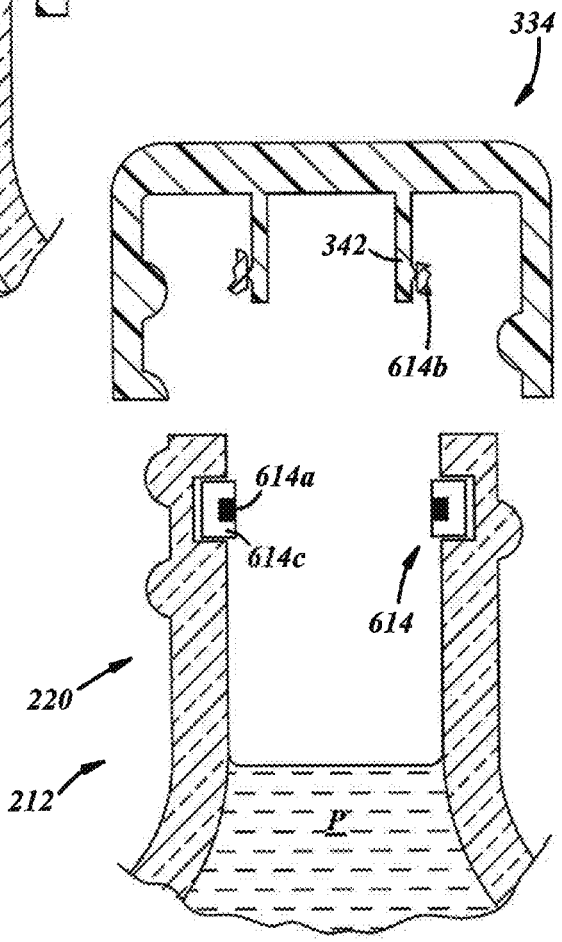
FIG. 13 is an elevational, fragmentary, cross-sectional view of the package of FIG. 12, illustrating the closure removed from the container and a protective portion of the indicator scraped away by the closure.

FIGS. 12-13 illustrate another embodiment of a package 310. This embodiment is similar in many respects to the embodiment of FIGS. 1-11 and like numerals between the embodiments generally designate like or corresponding elements throughout the several views of the drawing figures. Accordingly, the descriptions of the embodiments are incorporated into one another, and description of subject matter common to the embodiments generally may not be repeated here.

FIG. 12 illustrates the package 310 as including a product that includes the container 212 of FIGS. 10A-11 and a use indicator 614 carried inside the container 212, and also including a flowable product P in the container 212, and a closure 334 coupled to the container 212. The closure 334 may include a base wall 338, an annular outer skirt 340 extending axially from the base wall 338, and an annular inner skirt 342 extending axially from the base wall 338 radially inwardly of the outer skirt 340 and including a scraper 343. The scraper 343 may include a radially outwardly extending annular projection with or without a sharp apex, or may include an abrasive, multiple apexes, or the like. The outer skirt 342 may include one or more container engagement features 344 for engagement with the corresponding one or more closure engagement features 246 of the container neck 220.

The indicator 614 may be carried in the annular groove 232 of the container 212, or in any suitable location in the container 212. As illustrated, the indicator 614 may, but need not, have an inner diameter smaller than that of portions of the neck 220 axially adjacent to the indicator 614. The indicator 614 may be of any suitable composition(s) and constructed in any suitable manner to enable the indicator 614 to exhibit different visual characteristics. For example, the indicator 614 may be composed of an air-reactive material 614*a* reactive to one or more constituents of air, a carrier 614*c* to carry the air-reactive material 614*a*, and a protective material 614*b* carried by at least one of the air-reactive material 614*a* or the carrier 614*c*, and in contact with the scraper 343 of the inner skirt 242 of the closure 234. As before, the air-reactive material 614*a* itself may partially or entirely include the air-reactive material. As shown in FIG. 12, the indicator 614 exhibits a first visual characteristic.

As illustrated in FIG. 13, the closure 334 may be removed from the container neck 220, for example, in a twist off manner, such that removal of the closure 334 scrapes the protective material 614*b* away from the air-reactive material 614*a* to expose the air-reactive material 614*a* to air. Accordingly, with the closure 334 and the protective material 614*b* removed, a characteristic of the indicator 614 has irreversibly changed and is visible from outside of the container 212 to indicate to a user that the integrity of an as-packaged state of the package has been compromised. Accordingly, the indicator 614 exhibits a second visual characteristic different from the first visual characteristic, for example, the air-reactive material 614*a* of the indicator 614 may darken as shown in FIG. 13 from its lighter state as shown in FIG. 12.

Figure 14:
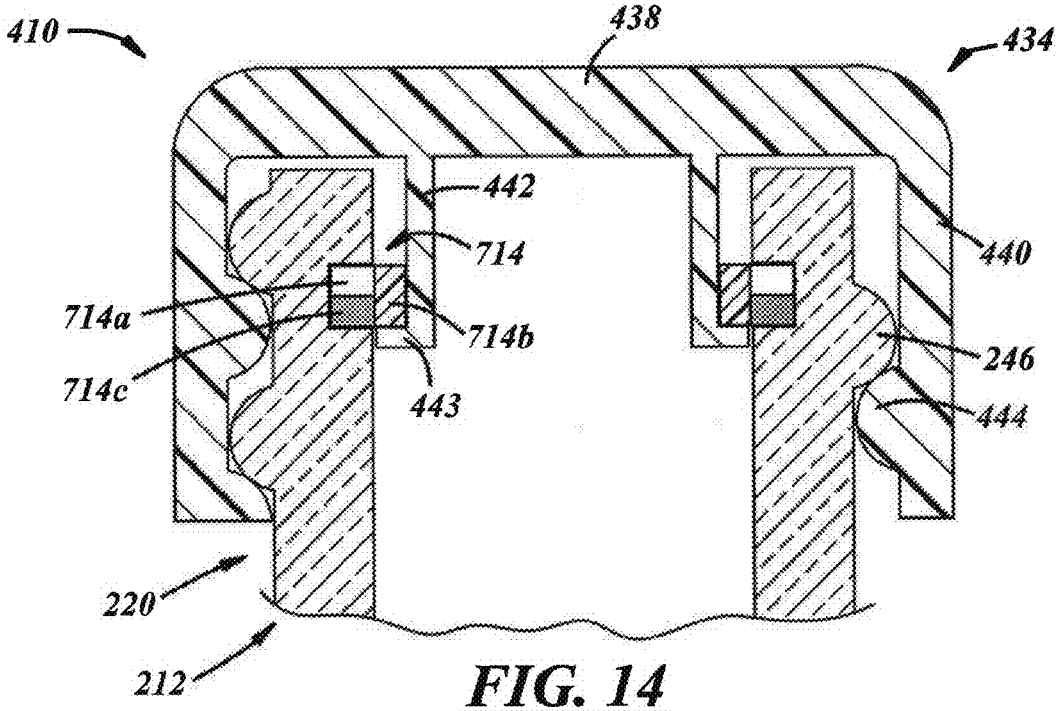
FIG. 14 is an elevational, fragmentary, cross-sectional view of a package in accordance with yet another illustrative embodiment of the present disclosure and including a container, a closure coupled to the container, and a use indicator coupled to the container and positioned between the closure and the container.
Figure 15:
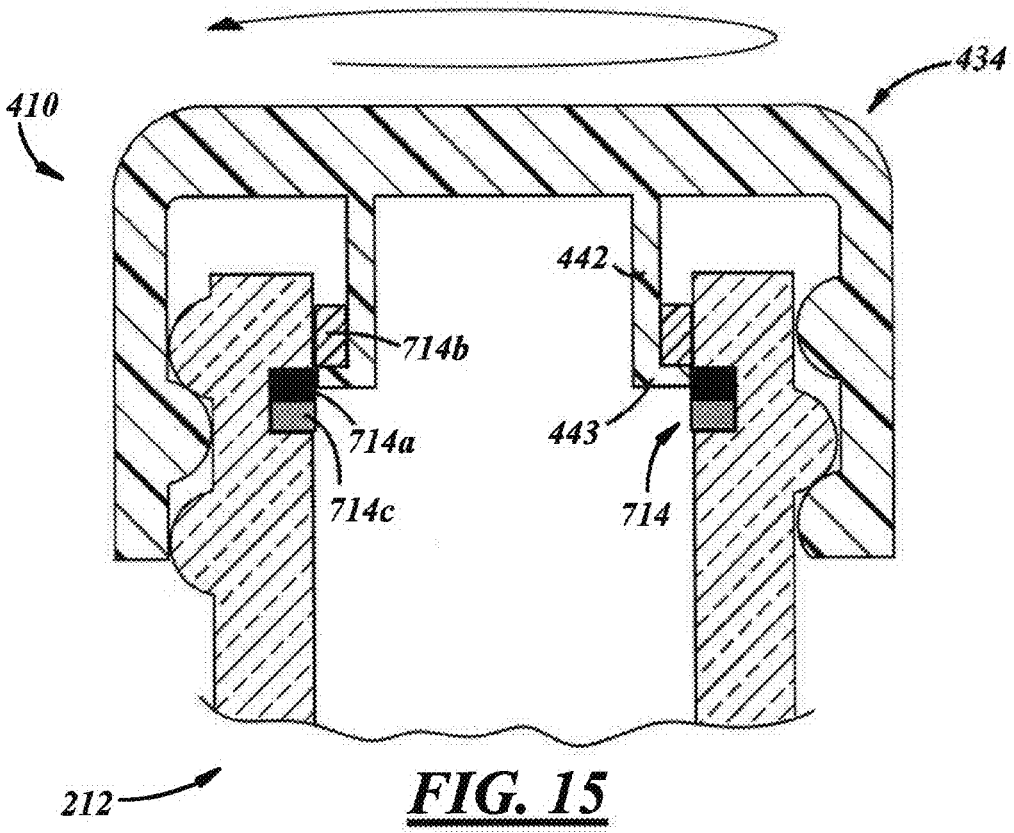
FIG. 15 is an elevational, fragmentary, cross-sectional view of the package of FIG. 14, illustrating the closure being removed from the container and a protective portion of the indicator being removed by the closure.

FIGS. 14-15 illustrate another embodiment of a package 410. This embodiment is similar in many respects to the embodiment of FIGS. 1-13 and like numerals between the embodiments generally designate like or corresponding elements throughout the several views of the drawing figures. Accordingly, the descriptions of the embodiments are incorporated into one another, and description of subject matter common to the embodiments generally may not be repeated here.

FIG. 14 illustrates the package 410 as including a product that includes the container 212 of FIGS. 10A-13 and a use indicator 714 carried inside the container 212, and a closure 434 coupled to the container 212. The closure 434 may include a base wall 438, an annular outer skirt 440 extending axially from the base wall 438, and an annular inner skirt 442 extending axially from the base wall 438 radially inwardly of the outer skirt 440 and including a radially outwardly extending annular foot or flange 443. After desired insertion of the closure 434 into the container 212, the flange 443 is located axially inwardly of, or beneath, a portion of the indicator 714, as will be described in further detail below. The outer skirt 440 may include one or more container engagement features 444 for engagement with the corresponding one or more closure engagement features 246 of the container neck 220.

The indicator 714 may be carried in a corresponding annular groove of the container 212, or in any suitable location in the container 212. As illustrated, the indicator 714 includes an inner diameter smaller than that of portions of the neck 220 axially adjacent to the indicator 714. The indicator 714 may be composed of an air-reactive material 714*a*, a protective material 714*b*, and a separate scavenging material 714*c*. As shown in FIG. 14, the indicator 714 exhibits a first visual characteristic.

As illustrated in FIG. 15, the closure 434 may be removed from the container neck 220, for example, in a twist off manner, such that removal of the closure 434 pulls the protective material 714*b* to remove, by shearing, stripping, or the like, the protective material 714*b* from the air-reactive material 714*a* to expose the air-reactive material 714*a* to air. Accordingly, with the closure 434 and the protective material 714*b* removed, a characteristic of the indicator 714 irreversibly changes and is visible from outside of the container 212 to indicate to a user that the integrity of an as-packaged state of the package has been compromised. Accordingly, the indicator 714 exhibits a second visual characteristic different from the first visual characteristic, for example, the air-reactive material 714*a* of the indicator 714 may darken as shown in FIG. 15 from its lighter state as shown in FIG. 14.

Figure 16:
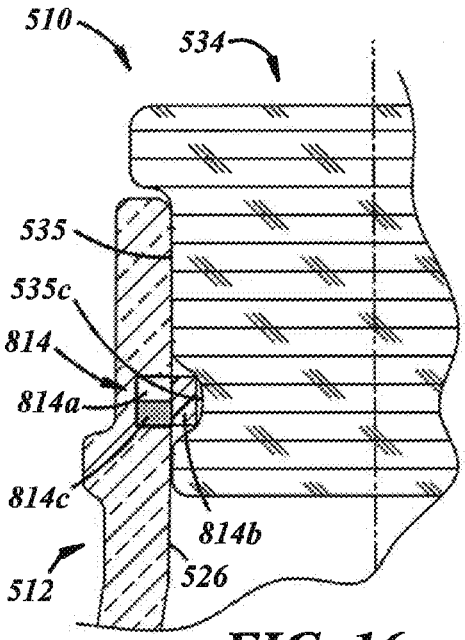
FIG. 16 is an elevational, fragmentary, cross-sectional view of a package in accordance with still another illustrative embodiment of the present disclosure and including a container, a closure coupled to the container, and a use indicator coupled to the container and positioned between the closure and the container.
Figure 17:
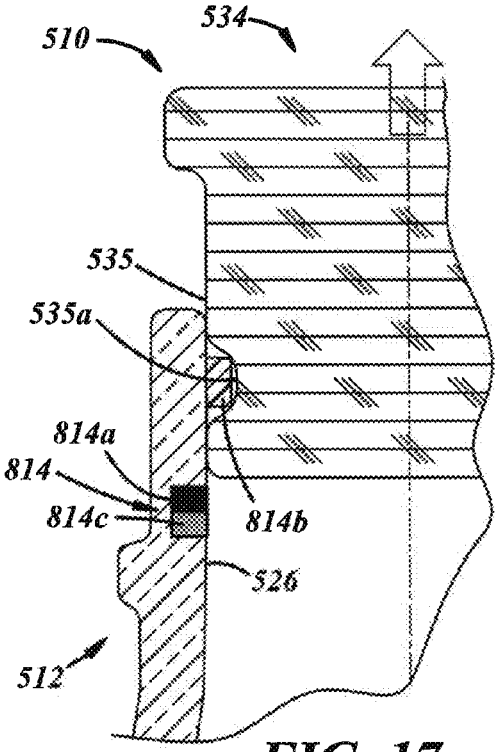
FIG. 17 is an elevational, fragmentary, cross-sectional view of the package of FIG. 16, illustrating the closure being removed from the container and a protective portion of the indicator being removed by the closure.

FIGS. 16-17 illustrate another embodiment of a package 510. This embodiment is similar in many respects to the embodiment of FIGS. 1-15 and like numerals between the embodiments generally designate like or corresponding elements throughout the several views of the drawing figures. Accordingly, the descriptions of the embodiments are incorporated into one another, and description of subject matter common to the embodiments generally may not be repeated here.

The package 510 includes an indicator 814 received in an annular relief in an interior surface 526 of a container 512 and having an air-reactive material 814*a*, a protective material 814*b*, and a scavenging material 814*c*. The package 510 is particularly similar to the package 110 of FIGS. 4-9, but here the closure 534 includes an outer diameter 535 with an annular relief 535*a* that may correspond to the indicator 814. The annular relief 535*a* may be partially or completely preformed, or may be established by radial compression by contact with the scavenging material 814*c*, for example, where the closure 534 is radially compressed during insertion into the container 512 and then allowed to radially expand thereafter.

In any case, as shown in FIG. 17, the protective material 814*b* may be removed, by shearing, stripping, or the like, from the rest of the indicator 814 when the closure 534 is removed from the container 512. Accordingly, with the closure 534 and the protective material 814*b* removed, a characteristic of the indicator 814 irreversibly changes and is visible from outside of the container 512 to indicate to a user that the integrity of an as-packaged state of the package has been compromised. Accordingly, the indicator 814 exhibits a second visual characteristic different from the first visual characteristic, for example, the air-reactive material 814*a* of the indicator 814 may darken as shown in FIG. 17 from its lighter state as shown in FIG. 16.

Figure 18:
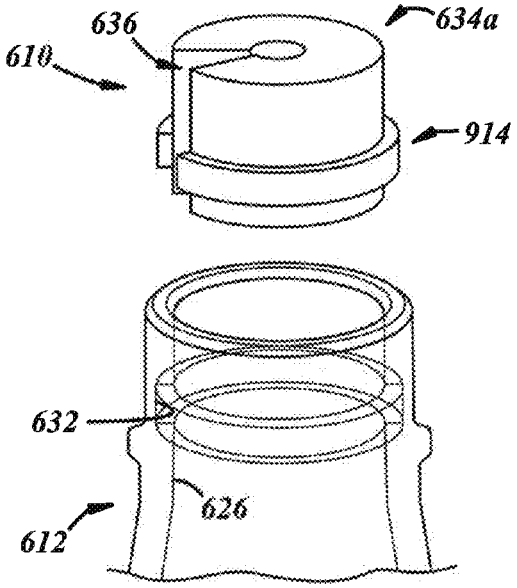
FIG. 18 is a perspective, fragmentary, exploded view of a package in accordance with another illustrative embodiment of the present disclosure and including a container, and a closure member carrying a use indicator.
Figure 19:
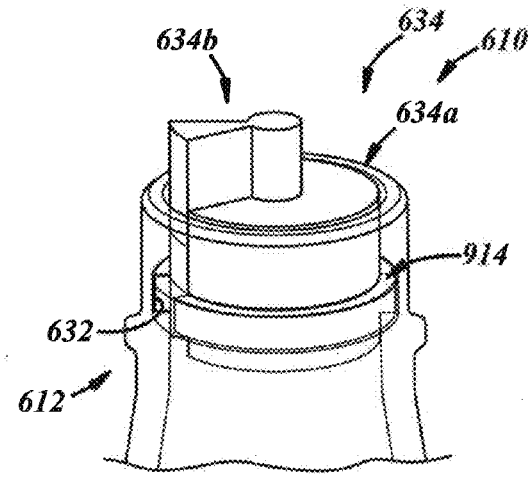
FIG. 19 is a perspective, fragmentary, exploded view of the package of FIG. 18, illustrating the closure member and the indicator inserted into the container and a wedge member inserted into the closure member to expand the closure member into sealing contact with the container.

FIGS. 18-19 illustrate another embodiment of a package 610. This embodiment is similar in many respects to the embodiment of FIGS. 1-17 and like numerals between the embodiments generally designate like or corresponding elements throughout the several views of the drawing figures. Accordingly, the descriptions of the embodiments are incorporated into one another, and description of subject matter common to the embodiments generally may not be repeated here.

The package 610 includes a container 612 into which a closure member 634*a* and indicator 914 may be inserted, and including an interior surface 626 having an internal annular relief 632. The closure member 634*a* carries the indicator 914 in any suitable manner. For example, the indicator 914 may be carried about a circumferential outer surface of the member 634*a* or within an annular relief in the outer surface thereof. For example, a protective material portion (not separately shown) of the indicator 914 may be carried in such a relief, and an air-reactive material and/or an oxygen scavenging material (not separately shown) may extend outwardly of the outer surface of the closure member 634*a*. The closure member 634*a* also may include a wedge opening 636 extending radially and circumferentially through at least a portion of the closure member 634*a*. The opening 636 may include a sector portion and also may include a central portion open to the sector portion.

The closure member 634*a* and the indicator 914 may be inserted as an assembly into the open end of the container 612 until the indicator 914 is axially aligned with the annular relief 632 of the container 612. In one example, the closure member 634*a* and indicator 914 may be compressible to easily slip inside of the container 612.

Once the indicator 914 is aligned with the relief 632, and with reference to FIG. 19, a wedge member 634*b*, including portions corresponding to the wedge opening 636, may be inserted into the wedge opening 636. Such insertion may radially expand the closure member 634*a* into sealing engagement with the interior surface 626 of the container 612. Likewise, a circumferential outer surface of the wedge member 634*b* may be in sealing contact with a corresponding portion of the container interior surface 626 and other surfaces of the wedge member 634*b* may be in sealing contact with the closure member 634*a*.

Also, such insertion may radially expand the indicator 914 into the annular relief 632 of the container 612. For example, the air-reactive material and/or the oxygen scavenging material portions may extend radially outwardly, at least partially into the annular relief 632. As shown in FIG. 19, the wedge member 634*b* is only partially inserted into the closure member 634*a* but those of ordinary skill in the art will recognize that it can be further inserted axially into the closure member 634*a*, for example, until top surfaces of the two components are flush. The closure member 634*a* and the wedge member 634*b* may constitute a closure assembly 634.

Accordingly, the protective material of the indicator 914 may be removed, by shearing, stripping, or the like, from the rest of the indicator 914 when the closure 634 is removed from the container 612 in any suitable manner.

There thus has been disclosed a product that has a use indicator and that fully satisfies all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A package that includes:

a container, wherein the container is a bottle having a neck, a body and a shoulder connecting the neck to the body, a product dispensably disposed within the container, a closure carried by the container, and an indicator within the container, the indicator being adapted, upon contact with air, irreversibly to change a characteristic of the indicator that is visible from outside of the container to indicate to a user that the package has been used wherein the indicator is adapted, upon contact with air, irreversibly to change the characteristic to indicate to a user that the integrity of an as-packaged state of the package has been compromised, and wherein the indicator is carried by an inside surface of the container neck and is covered by a portion of the closure within the container.

2. The package set forth in claim 1 wherein the characteristic is color of the indicator.

3. The package set forth in claim 1 wherein the indicator initially has a protective material that is dissolved by the product upon filling the container with the product.

4. The package set forth in claim 1 wherein the indicator is composed of an air-reactive material.

5. The package set forth in claim 1 wherein the indicator includes an air-reactive material composed of at least one of copper, iron, potassium, sodium, PEN (polyethylene naphthalate), or polycarbonate, and the indicator also includes a protective material over the air-reactive material and composed of at least one of polyacrylic acid, polyacrylamide, xanthan gum, pectin, chitosan derivatives, dextran, carrageenan, guar gum, and/or cellulose ethers including hydroxypropylmethyl cellulose (HPMC), hydroxypropyl cellulose (HPC), hydroxyethyl cellulose (HEC), or sodium carboxy methyl cellulose (Na-CMC).

6. The package set forth in claim 1 wherein the indicator includes a carrier material composed of at least one of glass, ceramic, metal, or polymer, and the indicator also includes an air-reactive material composed of at least one of a flavanone, flavanole, dihydrochalcone, chalcone, aurone, or anthocyanidin, and the indicator further includes a protective material composed of at least one of polyacrylic acid, polyacrylamide, xanthan gum, pectin, chitosan derivatives, dextran, carrageenan, guar gum, and/or cellulose ethers including hydroxypropylmethyl cellulose (HPMC), hydroxypropyl cellulose (HPC), hydroxyethyl cellulose (HEC), or sodium carboxy methyl cellulose (Na-CMC).

7. The package set forth in claim 1 wherein the indicator includes an air-reactive material composed of at least one of copper, iron, potassium, sodium, PEN (polyethylene naphthalate), or polycarbonate, and the indicator also includes a scavenging material adjacent to the air-reactive material and composed of at least one of iron carbonate, activated carbon, cobalt salt, iron powder, ascorbic acid, photosensitive polymers, or enzymes.

8. The package set forth in claim 1 wherein the container is a bottle having a base, a body extending from the base, a neck, and a shoulder connecting the neck to the body, and the indicator is carried in an upper portion of the container, closer to the neck than to the base.

9. The package set forth in claim 1 wherein the indicator is adapted, upon removal of the closure and of product from the container, irreversibly to change the characteristic to indicate to a user that product has been removed from the container.

10. The package set forth in claim 1 wherein the indicator includes a protective material adapted to be removed by the closure.

11. The package set forth in claim 10 wherein at least a portion of the closure is friction-fit within the container neck and within the indicator, such that removal of the closure frictionally pulls the protective material.

12. The package set forth in claim 10 wherein the closure includes an inner skirt coupled to the protective material within the container neck, such that removal of the closure peels the protective material.

13. The package set forth in claim 10 wherein the closure includes an inner skirt having a radially outer projection in contact with the protective material within the container neck, such that removal of the closure scrapes the protective material.

14. The package set forth in claim 10 wherein the closure includes an inner skirt having a radially outer flange disposed axially inward of the protective material within the container neck, such that removal of the closure pulls the protective material away.

15. The package set forth in claim 1 wherein the indicator includes an air-reactive material, and the closure includes an inner skirt having an outer surface in contact with the air-reactive material within the container neck, such that removal of the closure exposes the air-reactive material.

16. A product that include:

a container, and an indicator carried inside the container, and including an air-reactive material and a protective material on the air-reactive material, and having a firt visible characteristic with the protective material, and a second visible characteristic when exposed to air without the protective material, wherein the container is a bottle that includes a base, a body extending from the base, a shoulder extending from the body, and a neck, and indicator is carried in an upper portion of the container, closer to the neck than to the base, wherein the air-reactive material is composed of at least one of copper, iron, potassium, sodium, PEN (polyethylene naphthalate), or polycarbonate, and the protective material is composed of at least one of at least one of polyacrylic acid, polyacrylamide, xanthan gum, pectin, chitosan derivatives, dextran, carrageenan, guar gum, and/or cellulose ethers including hydroxypropylmethyl cellulose (HPMC), hydroxypropyl cellulose (HPC), hydroxyethyl cellulose (HEC), or sodium carboxy methyl cellulose (Na-CMC).

17. A product that includes:

a container; and an indicator carried inside the container, and including an air-reactive material and a protective material on the air-reactive material, and having a first visible characteristic with the protective material, and a second visible characteristic when exposed to air without the protective material, wherein the air-reactive material is composed of at least one of copper, iron, potassium, sodium, PEN (polyethylene naphthalate), or polycarbonate, and the indicator also includes a scavenging material adjacent to the air-reactive material and composed of at least one of iron carbonate, activated carbon, cobalt salt, iron powder, ascorbic acid, photosensitive polymers, or enzymes.

18. A method of producing a package that includes:

(a) positioning an air-reactive indicator inside of a container, wherein the indicator includes a protective material and has a first visible characteristic;

(b) flowing a flowable product into the container; and (c) assembling a closure to the container;

wherein the flowing step (b) includes covering the indicator with the flowable product to dissolve the protective material.

19. The method set forth in claim 18 wherein the positioning step (a) includes assembling the indicator to an inside surface of the container.

20. A method of using a package produced by a method of producing the package that includes (a) positiong an air-reactive indicator inside of a container, wherein the indicator includes a protective material and has a first visible characteristic; (b) flowing a flowable product into the container; and (c) assembling a closure to the container; wherein the method of using the package wherein the method of using the package includes;

removing the closuer to open the container; and dispensing the flowable product out of the container and over the indicator;

such that the indicator is exposed to air and, thus, exhibits a second, different visible characteristic that is irreversible to the fist characteristic, wherein the indicator is a ring disposed around an inside surface of the container neck and is covered by a portion of the closure within the container.

21. A package used by the method of claim 20.

22. A method of using the package set forth in claim 21 that includes removing the closure to open the container, such that the protective material is removed by removal of the closure so as to expose the indicator to air so that the indicator exhibits a second, different visible characteristic that is irreversible to the first characteristic.

23. The method set forth in claim 22 wherein removal of the closure frictionally pulls the protective material.

24. The method set forth in claim 22 wherein removal of the closure pulls the protective material away.

* * * * *